US010358751B2

(12) United States Patent
Castelli et al.

(10) Patent No.: US 10,358,751 B2
(45) Date of Patent: Jul. 23, 2019

(54) YARN FEEDER WITH MOTORIZED YARN WINDING SPOOL

(71) Applicant: L.G.L. ELECTRONICS S.p.A., Gandino (IT)

(72) Inventors: Rosario Castelli, Gandino (IT); Pietro Zenoni, Leffe (IT)

(73) Assignee: L.G.L. ELECTRONICS S.P.A., Gandino (IT)

( * ) Notice: Subject to any disclaimer, the term of this patent is extended or adjusted under 35 U.S.C. 154(b) by 83 days.

(21) Appl. No.: 15/624,133

(22) Filed: Jun. 15, 2017

(65) Prior Publication Data

US 2017/0362752 A1 Dec. 21, 2017

(30) Foreign Application Priority Data

Jun. 17, 2016 (IT) ..... 102016000062490

(51) Int. Cl.
*B65H 51/22* (2006.01)
*B65H 59/18* (2006.01)
*D04B 15/48* (2006.01)

(52) U.S. Cl.
CPC ..... *D04B 15/482* (2013.01); *B65H 51/22* (2013.01); *B65H 59/18* (2013.01); *D04B 15/48* (2013.01); *B65H 2701/31* (2013.01)

(58) Field of Classification Search
CPC .... B65H 51/22; B65H 59/18; B65H 2701/31; D04B 15/48; D04B 15/482
See application file for complete search history.

(56) References Cited

U.S. PATENT DOCUMENTS 7,591,153 B2 * 9/2009 Huss ..... D04B 15/48 66/132 R
2007/0210198 A1 9/2007 Huss

FOREIGN PATENT DOCUMENTS

WO 03093550 A1 11/2003

* cited by examiner

*Primary Examiner* — William E Dondero
(74) *Attorney, Agent, or Firm* — Cantor Colburn LLP

(57) ABSTRACT

A yarn winding assembly installed on a support includes a motorized spool and an oblique spacer pin, between which a yarn is wound. The spacer pin is supported rotatably by a rotating supporting component so that it is entrained in two directions by the yarn wound between the spool and the spacer pin. The rotation of the spacer pin is delimited by an element of arrest at least in a direction of unwinding the yarn.

10 Claims, 5 Drawing Sheets

YARN FEEDER WITH MOTORIZED YARN WINDING SPOOL

CROSS-REFERENCE TO RELATED APPLICATIONS

This application is related to and claims the benefit of Italian Patent Application No. 102016000062490, filed on Jun. 17, 2016, the contents of which are herein incorporated by reference in their entirety.

TECHNICAL FIELD

The present disclosure relates to a yarn feeder with motorized yarn winding spool.

BACKGROUND

Yarn feeders are known, of the so-called "positive" type, in which the yarn originating from a distaff is repeatedly wound between a motorized spool and a spacer pin with an axis that is slightly oblique with respect to the axis of the spool. By making the spool rotate in the direction of unwinding, the yarn is fed to a textile machine downstream, e.g., a knitting machine.

The function of the spacer pin is to maintain the yarn loops wound on the spool, axially spaced apart from each other.

The yarn tension is continuously monitored by a load cell connected to a control unit. The latter, on the basis of the signal received from the load cell, modulates the speed of the spool so as to keep substantially constant at a desired level the tension of the yarn fed to the machine downstream, to the advantage of the quality of the knitting produced.

As is known, in knitting processes, often the yarn feeder has to recover a part of the yarn that was previously supplied to the machine downstream.

In these cases, a gathering device can be provided upstream of the feeder. During recovery, the yarn winding spool is made rotate in the opposite direction with respect to the direction for feeding and, simultaneously, the gathering device is activated in order to keep the yarn upstream of the spool under tension.

A solution of this type is illustrated, e.g., in EP 1501970 B1, where the gathering device is based on a Venturi tube.

The introduction of a gathering device upstream of the spool implies a not insignificant increase in cost, not least because it needs to be controlled so that it is activated synchronously with the spool.

SUMMARY

The aim of the present disclosure is to provide a yarn feeder with motorized yarn winding spool that, although it has no dedicated gathering device upstream, makes it possible to keep the yarn under tension on the yarn winding spool even during recovery, with a solution that is simple in construction and also low cost.

The above aim and other advantages, which will become clearer from the description that follows, are achieved by the yarn feeder having a support and a yarn winding assembly mounted on the support and comprising a motorized spool and an oblique spacer pin, between which a yarn is adapted to be wound, wherein said spacer pin is supported rotatably by rotating supporting means so that it is entrained in two directions by the yarn wound between the motorized spool and the spacer pin, a rotation of the spacer pin being delimited by means of arrest in a direction of unwinding of the yarn. t The appended dependent claims define other characteristics of the disclosure which are advantageous, although secondary.

BRIEF DESCRIPTION OF THE DRAWINGS

Now the disclosure will be described in more detail, with reference to some preferred, but not exclusive, embodiments thereof, which are illustrated for the purposes of non-limiting example in the accompanying drawings, wherein.

DETAILED DESCRIPTION OF THE DRAWINGS

Figure 1:
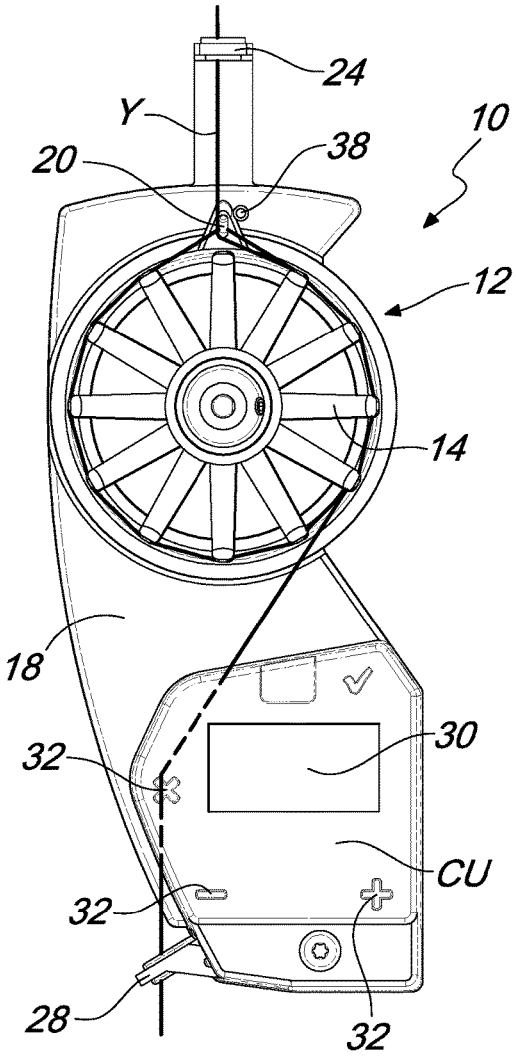
FIG. 1 is a front elevation view of the yarn feeder according to the disclosure.
Figure 2:
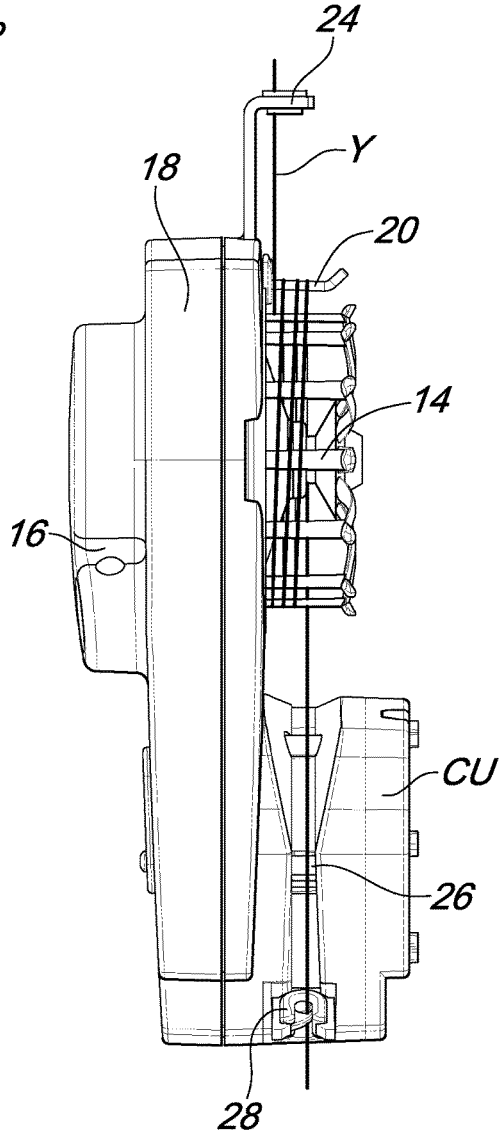
FIG. 2 is a side view of the yarn feeder of FIG. 1.
Figure 3:
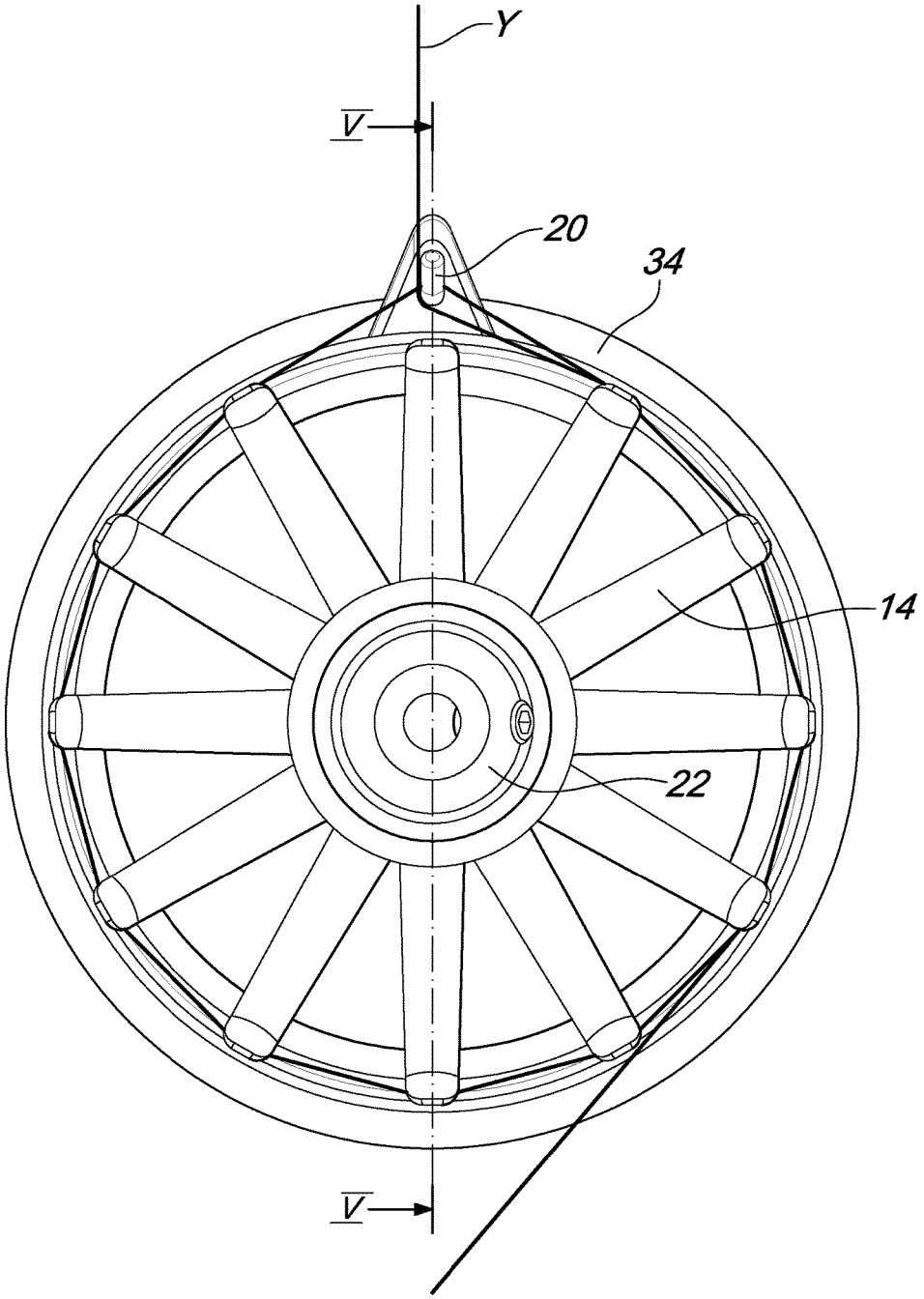
FIG. 3 is a front elevation view of an isolated component of the yarn feeder of FIG. 1.
Figure 4:
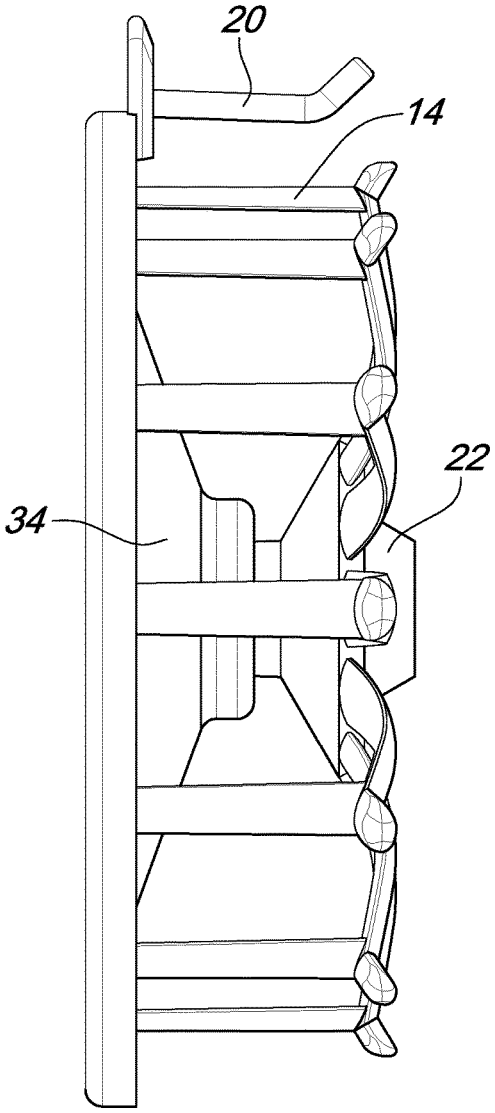
FIG. 4 is a side view of the component of FIG. 3.

With initial reference to FIGS. 1-6, a yarn feeder 10 is provided with a yarn winding assembly 12 that comprises a spool 14 entrained in rotation by an electric motor 16 accommodated in a support 18, and a spacer pin 20 that extends from the support 16 with an axis that is slightly inclined toward the axis of the spool. In a way that is known per se, the spool 14 is mounted on a hub 22 (FIG. 5) which is keyed to the shaft (not shown) of the electric motor 16.

The yarn Y originating from a distaff (not shown), after having passed through an entry yarn guiding bush 24 that is integral with the support 18, is repeatedly wound (e.g., four or five windings) between the spool 14 and the spacer pin 20. The latter, in a conventional manner, has the function of keeping the yarn loops wound on the yarn winding assembly 12 axially spaced apart from each other.

The yarn Y being unwound from the yarn winding assembly 12 functionally engages a load cell 26 (FIG. 2) incorporated in the feeder, after which it is fed to the machine downstream by way of an exit yarn guiding bush 28 that is integral with the support 18.

In a conventional way, the motor 16 is driven by a control unit CU that is also incorporated in the feeder, which is programmable by way of a display 30 and buttons 32. The control unit CU modulates the speed of the spool 14 on the basis of the signal received from the load cell 26, so as to keep the yarn tension Y substantially constant at a desired level; such tension depends on the difference between the speed with which the yarn is fed out by the feeder and the speed with which it is taken up by the machine downstream.

The programming of the control unit CU comes under the normal knowledge of the person skilled in the art and therefore it will not be described here.

Figure 5:
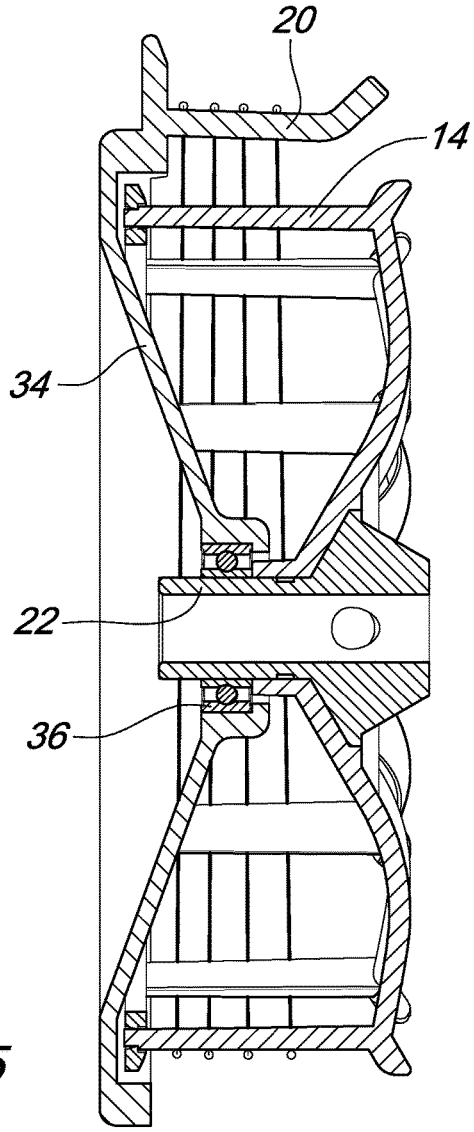
FIG. 5 is a cross-sectional view of FIG. 3 taken along the line V-V.

According to the disclosure, the spacer pin 20 is integral with rotating supporting means 34 which are supported rotatably about the axis of the spool 14 by way of a bearing 36 which is also fitted on the hub 22 (FIG. 5). The rotating supporting means comprise a flywheel 34, the rotation of the flywheel 34 being delimited in the direction of unwinding by an abutment 38.

In the embodiment described herein, the abutment 38 is arranged so as to block the flywheel 34 in such a position that, by inserting the yarn between the spacer pin 20 and the spool 14 before winding it, the yarn passes through the entry yarn guiding bush 24 in a substantially radial direction with respect to the spool.

Now the operation of the yarn feeder according to the disclosure will be described.

During feeding, the yarn feeder 10 behaves traditionally. The spool 14 rotates in the direction of unwinding (clockwise direction in FIGS. 1, 3 and 6) and, by virtue of the friction between the yarn Y and the spacer pin 20, the flywheel 34 is pushed in abutment against the abutment 38, as illustrated in FIG. 1. In this step, therefore, the spacer pin 20 acts conventionally as if it were integral with the support 18.

Figure 6:
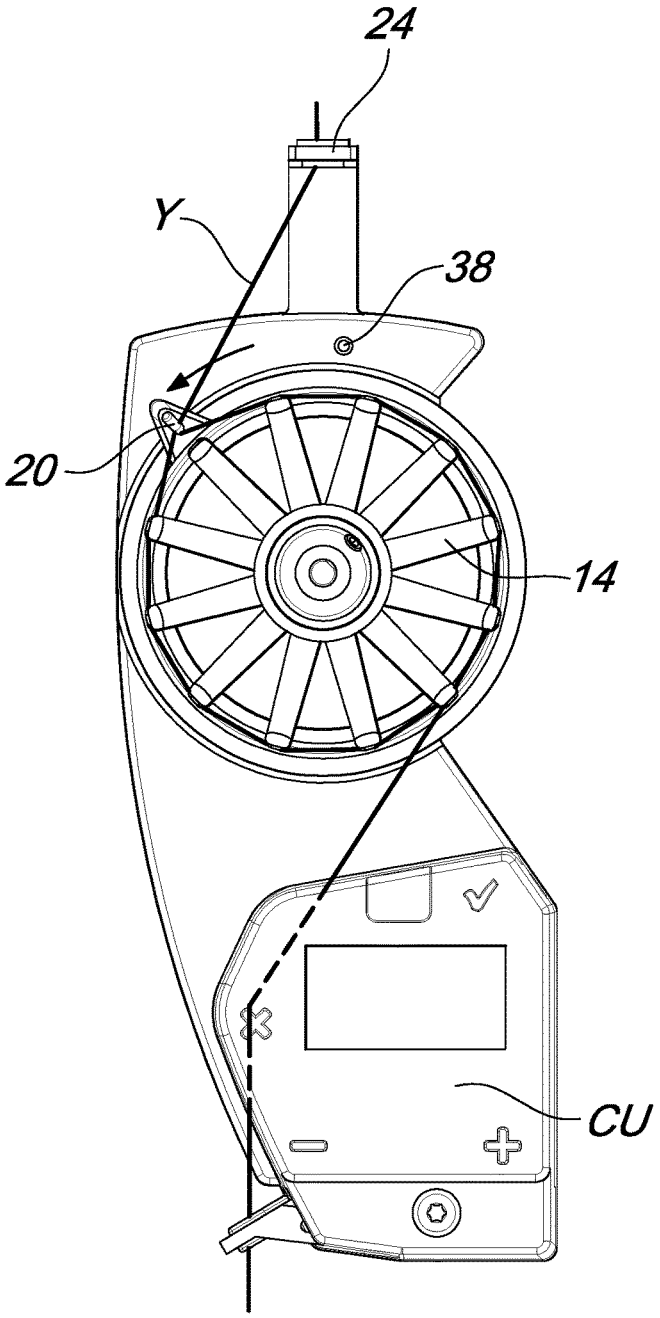
FIG. 6 is a view similar to FIG. 1, showing the yarn feeder in a different operating configuration.

During recovery, the spool 14 is made to rotate in the opposite direction (anticlockwise direction in FIGS. 1, 3 and 6) in order to recover the yarn. By virtue of the friction between the yarn Y and the spacer pin 20, the flywheel 34 is also entrained in rotation in the same direction (anticlockwise direction in FIGS. 1, 3 and 6), so as to keep the yarn under tension (FIG. 6).

In the subsequent feeding cycle, by virtue of the friction between the yarn Y and the spacer pin 20, the flywheel 34 will once again be pushed in abutment against the abutment 38 and the feeding will be resumed conventionally (FIG. 1).

As the person skilled in the art will be able to appreciate, the yarn feeder 10 fully achieves the set aims, by making it possible to keep the yarn under tension even during the steps of recovery without it being necessary to install a dedicated gathering device upstream, with a solution that is simple in construction and low cost.

Figure 7:
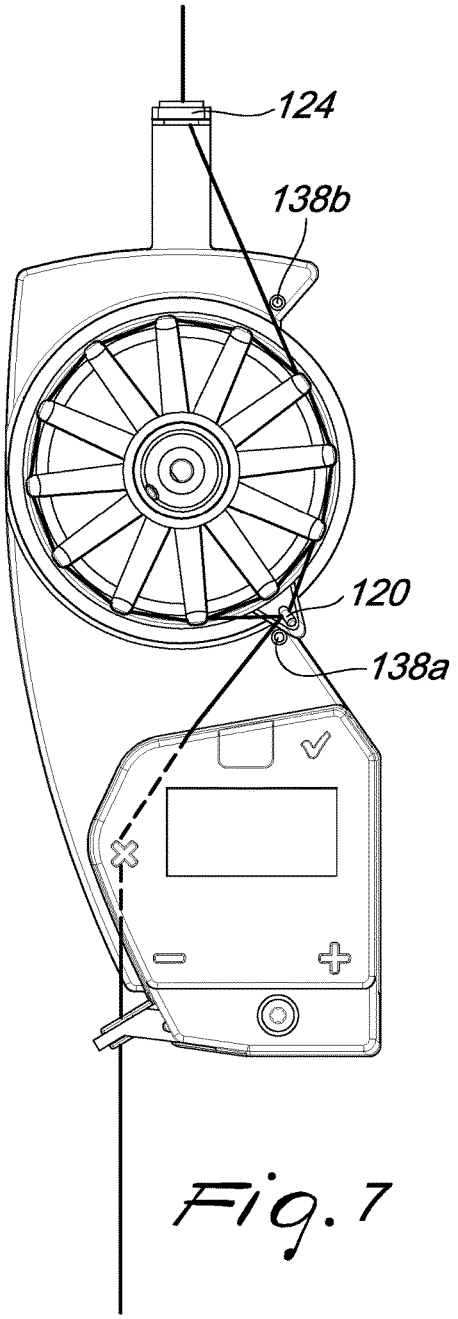
FIGS. 7 and 8 are views similar to FIGS. 1 and 6 respectively and showing an alternative embodiment of the disclosure.
Figure 8:
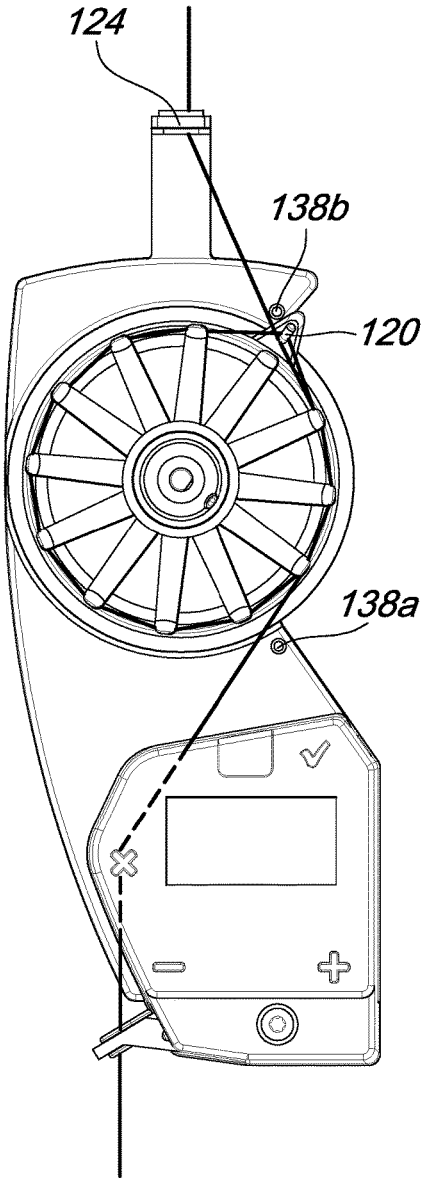

FIGS. 7 and 8 show an alternative embodiment of the disclosure, in which the elements similar to the previous embodiment are designated by the same reference numerals increased by 100.

Such embodiment differs from the previous one only in that the rotation travel of the spacer pin 120 is delimited both in the direction of unwinding by first means of arrest 138*a*, and in the direction of winding by second means of arrest 138*b*.

In the example described herein, the first means of arrest 138*a* and the second means of arrest 138*b* are arranged so as to block the rotation of the spacer pin 120 in positions such that the incoming yarn is not deviated, either during unwinding or during recovery.

Note that, according to such alternative embodiment, the yarn arriving from the entry yarn guiding bush 124 could also pass outside the spacer pin 120 before being wound on the spool.

Some preferred embodiments of the disclosure have been described, but obviously the person skilled in the art may make various modifications and variations within the scope of the appended claims.

For example, although in the embodiment described the spacer pin is mounted on a flywheel for an effective balancing of the centrifugal loads, it could alternatively be supported by other rotating supporting means, e.g., a rotating arm optionally ballasted on the opposite side.

Furthermore, the spacer pin could also be pivoted eccentrically, or about a skew axis with respect to the spool, e.g., in order to vary the tensioning curve during recovery.

Last but not least, the abutments could be substituted by different means of arrest as long as they are capable of blocking the rotation of the pin at a desired point, including electrically-actuated pins, or even mechanical or magnetic brakes or brakes of any other type.

Furthermore, as specified previously, the arrest positions of the spacer pin can be varied according to requirements.

What is claimed is:

1. A yarn feeder, provided with a support and with a yarn winding assembly mounted on the support and comprising a motorized spool and an oblique spacer pin, between which a yarn is adapted to be wound, wherein said spacer pin is supported in an idle manner rotatably by rotating supporting means so that said spacer pin is entrained in two directions by the yarn wound between the motorized spool and the spacer pin, a rotation of the spacer pin being delimited by arrest means in a direction of unwinding of the yarn.

2. The yarn feeder according to claim 1, wherein said arrest means comprises an abutment.

3. The yarn feeder according to claim 1, wherein said spacer pin is supported rotatably about an axis that is substantially parallel to the axis of the motorized spool.

4. The yarn feeder according to claim 3, wherein said spacer pin is supported rotatably about the axis of the spool.

5. The yarn feeder according to claim 1, wherein said rotating supporting means comprise a flywheel.

6. The yarn feeder according to claim 1, wherein said rotating supporting means are supported by a motorized hub by way of a bearing.

7. The yarn feeder according to claim 6, wherein said spool is also mounted on said hub.

8. The yarn feeder according to claim 1, further comprising an entry yarn guiding bush upstream of said yarn winding assembly, and wherein said arrest means are configured to block said spacer pin in such a position that, by inserting the yarn between the spacer pin and the motorized spool before winding the yarn, said yarn passes through said entry yarn guiding bush in a substantially radial direction with respect to the motorized spool.

9. The yarn feeder according to claim 1, further comprising additional arrest means arranged so as to delimit the rotation of the spacer pin in a take-up direction.

10. The yarn feeder according to claim 9, wherein said additional arrest means comprises an additional abutment.

* * * * *